US007984957B2

(12) United States Patent
Tabata et al.

(10) Patent No.: US 7,984,957 B2
(45) **Date of Patent: *Jul. 26, 2011**

(54) LIQUID JET APPARATUS, PRINTING APPARATUS, AND METHOD OF ADJUSTING PHASE OF DRIVE PULSE

(75) Inventors: Kunio Tabata, Shiojiri (JP); Toshiyuki Suzuki, Shiojiri (JP); Atsushi Oshima, Shiojiri (JP); Osamu Shinkawa, Chino (JP); Tomoki Hatano, Higashiomi (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

This patent is subject to a terminal disclaimer.

(21) Appl. No.: 12/509,915

(22) Filed: Jul. 27, 2009

(65) Prior Publication Data

US 2009/0289980 A1 Nov. 26, 2009

Related U.S. Application Data

(63) Continuation of application No. 11/780,301, filed on Jul. 19, 2007, now Pat. No. 7,581,802.

(30) Foreign Application Priority Data

Jul. 20, 2006 (JP) ..... 2006-198207
Jul. 11, 2007 (JP) ..... 2007-181649

(51) Int. Cl.
*B41J 29/38* (2006.01)

(52) U.S. Cl. ..... 347/14; 347/11

(58) Field of Classification Search ..... 347/9–12, 347/14, 15, 19, 40–43, 56–57
See application file for complete search history.

(56) References Cited

U.S. PATENT DOCUMENTS

| | | | |
|---|---|---|---|
| 2,915,589 | A | 12/1959 | Plant |
| 5,262,733 | A | 11/1993 | Nakajima et al. |
| 5,475,405 | A | 12/1995 | Widder et al. |
| 5,894,314 | A | 4/1999 | Tajika et al. |
| 6,267,519 | B1 | 7/2001 | Otsuki et al. |
| 6,312,076 | B1 | 11/2001 | Taki et al. |
| 6,312,096 | B1 | 11/2001 | Koitabashi et al. |
| 6,320,605 | B1 | 11/2001 | Ikeda et al. |
| 6,344,811 | B1 | 2/2002 | Melanson |
| 6,364,443 | B1 | 4/2002 | Katano et al. |

(Continued)

FOREIGN PATENT DOCUMENTS

EP 1594224 11/2005

(Continued)

OTHER PUBLICATIONS

U.S. Appl. No. 12/161,201, filed Jul. 17, 2008, Oshima et al.

(Continued)

*Primary Examiner* — Thinh H Nguyen
(74) *Attorney, Agent, or Firm* — Maschoff Gilmore & Israelsen

(57) ABSTRACT

A liquid jet apparatus including a plurality of nozzles provided to a liquid jet head, an actuator corresponding to each of the nozzles, and drive unit that applies a drive pulse to each of the actuators, wherein the drive unit includes correction value storing unit that stores a drive pulse application timing correction value corresponding to the number of actuators to be driven at the same time, and drive pulse application timing correction unit that corrects the drive pulse application timing using the drive pulse application timing correction value stored in the correction value storing unit.

7 Claims, 12 Drawing Sheets

U.S. PATENT DOCUMENTS

| | | | | |
|---|---|---|---|---|
| 6,474,762 | B2 | 11/2002 | Taki et al. | |
| 6,652,055 | B2 | 11/2003 | Oikawa | |
| 6,776,469 | B2 | 8/2004 | Nozawa | |
| 7,038,534 | B2 | 5/2006 | Hanzlik | |
| 7,083,274 | B2 | 8/2006 | Morita | |
| 7,111,755 | B2 * | 9/2006 | Koyama et al. | 222/1 |
| 7,244,007 | B2 | 7/2007 | Ishizaki | |
| 7,252,355 | B2 | 8/2007 | Umeda | |
| 7,384,128 | B2 * | 6/2008 | Sheahan et al. | 347/42 |
| 7,571,989 | B2 | 8/2009 | Ishizaki | |
| 7,581,802 | B2 | 9/2009 | Tabata et al. | |
| 7,717,530 | B2 | 5/2010 | Oshima | |
| 7,731,317 | B2 | 6/2010 | Oshima | |
| 7,748,812 | B2 | 7/2010 | Oshima | |
| 2002/0142733 | A1 | 10/2002 | Nishinakagawa | |
| 2002/0163458 | A1 | 11/2002 | Jin | |
| 2003/0112297 | A1 | 6/2003 | Hiratsuka et al. | |
| 2003/0231179 | A1 | 12/2003 | Suzuki | |
| 2005/0231179 | A1 | 10/2005 | Ishizaki | |
| 2005/0248399 | A1 | 11/2005 | Kurokawa | |
| 2006/0132231 | A1 | 6/2006 | Ishii et al. | |
| 2006/0181342 | A1 | 8/2006 | Kanoh | |
| 2007/0079710 | A1 | 4/2007 | Ishizaki | |
| 2007/0165074 | A1 | 7/2007 | Ishizaki | |
| 2008/0018683 | A1 | 1/2008 | Oshima et al. | |
| 2008/0018686 | A1 | 1/2008 | Oshima et al. | |
| 2008/0018687 | A1 | 1/2008 | Tabata et al. | |
| 2008/0100652 | A1 | 5/2008 | Oshima et al. | |
| 2008/0186350 | A1 | 8/2008 | Oshima et al. | |
| 2008/0198191 | A1 | 8/2008 | Oshima | |
| 2008/0218545 | A1 | 9/2008 | Oshima et al. | |
| 2009/0033698 | A1 | 2/2009 | Suzuki et al. | |
| 2009/0066739 | A1 | 3/2009 | Tabata et al. | |
| 2009/0213152 | A1 | 8/2009 | Tabata et al. | |
| 2009/0267979 | A1 | 10/2009 | Tabata et al. | |
| 2009/0289980 | A1 | 11/2009 | Tabata et al. | |
| 2009/0303271 | A1 | 12/2009 | Tabata et al. | |
| 2010/0097419 | A1 | 4/2010 | Oshima | |
| 2010/0188452 | A1 | 7/2010 | Oshima | |

FOREIGN PATENT DOCUMENTS

| | | |
|---|---|---|
| JP | 63-247059 | 10/1988 |
| JP | 02-262705 | 10/1990 |
| JP | 05-077456 | 3/1993 |
| JP | 05-199044 | 8/1993 |
| JP | 09-308264 | 11/1997 |
| JP | 10-081013 | 3/1998 |
| JP | 11-204850 | 7/1999 |
| JP | 2000-238262 | 9/2000 |
| JP | 2000-245162 | 9/2000 |
| JP | 2001-121697 | 5/2001 |
| JP | 2003-001824 | 1/2003 |
| JP | 2003-237068 | 8/2003 |
| JP | 2004-306434 | 11/2004 |
| JP | 2005-035062 | 2/2005 |
| JP | 2005-065068 | 3/2005 |
| JP | 2005-075475 | 3/2005 |
| JP | 2005-131928 | 5/2005 |
| JP | 2005-322957 | 11/2005 |
| JP | 2005-329710 | 12/2005 |
| JP | 2006-025151 | 1/2006 |
| JP | 2006-231882 | 9/2006 |
| JP | 2006-256151 | 9/2006 |
| JP | 2006-272907 | 10/2006 |
| JP | 2007-069555 | 3/2007 |
| JP | 2007-096364 | 4/2007 |
| JP | 2007-144867 | 6/2007 |
| JP | 2007-168172 | 7/2007 |
| JP | 2007-190708 | 8/2007 |
| JP | 2008-049698 | 3/2008 |
| JP | 2008-049699 | 3/2008 |
| JP | 2008-087467 | 4/2008 |

OTHER PUBLICATIONS

U.S. Appl. No. 12/637,412, filed Dec. 14, 2009, Oshima et al.
U.S. Appl. No. 12/689,926, filed Jan. 19, 2010, Oshima et al.
U.S. Appl. No. 11/780,301, Mail Date Jun. 27, 2008, Office Action.
U.S. Appl. No. 11/780,301, Mail Date Feb. 20, 2009, Final Office Action.
U.S. Appl. No. 11/780,301, Mail Date Jun. 16, 2009, Notice of Allowance.
U.S. Appl. No. 11/780,390, Mail Date Apr. 8, 2009, Notice of Allowance.
U.S. Appl. No. 11/849,582, Mail Date May 28, 2008, Office Action.
U.S. Appl. No. 11/849,582, Mail Date Dec. 30, 2009, Final Office Action.
U.S. Appl. No. 11/923,448, Mail Date Nov. 27, 2009, Office Action.
U.S. Appl. No. 11/780,357, Mail Date Oct. 28, 2009, Office Action.
U.S. Appl. No. 11/780,357, Mail Date May 12, 2010, Final Office Action.
U.S. Appl. No. 11/849,582, Mail Date Apr. 19, 2010, Notice of Allowance.
U.S. Appl. No. 11/923,448, Mail Date Apr. 28, 2010, Final Office Action.
U.S. Appl. No. 11/780,379, Mail Date Mar. 3, 2010, Office Action.
U.S. Appl. No. 12/351,472, Mail Date Jan. 4, 2010, Notice of Allowance.
U.S. Appl. No. 12/340,940, Mail Date Apr. 12, 2010, Notice of Allowance.
U.S. Appl. No. 12/161,148, Mail Date Mar. 30, 2010, Office Action.
U.S. Appl. No. 11/780,379, Mail Date Aug. 20, 2010, Final Office Action.
U.S. Appl. No. 12/161,148, Mail Date Sep. 16, 2010, Final Office Action.
U.S. Appl. No. 12/161,201, Mail Date Sep. 28, 2010, Office Action.
U.S. Appl. No. 12/637,412, Mail Date Aug. 23, 2010, Office Action.
U.S. Appl. No. 12/752,367, Mail Date Oct. 8, 2010, Office Action.

* cited by examiner

| | |
|---|---|
| ADDRESS 1 | DELAY TIME PERIOD CORRESPONDING TO NUMBER OF DRIVEN ACTUATORS OF 1 |
| ADDRESS 2 | DELAY TIME PERIOD CORRESPONDING TO NUMBER OF DRIVEN ACTUATORS OF 2 |
| ADDRESS 3 | DELAY TIME PERIOD CORRESPONDING TO NUMBER OF DRIVEN ACTUATORS OF 3 |
| ADDRESS 4 | DELAY TIME PERIOD CORRESPONDING TO NUMBER OF DRIVEN ACTUATORS OF 4 |
| ⋮ | ⋮ |
| ADDRESS (N-3) | DELAY TIME PERIOD CORRESPONDING TO NUMBER OF DRIVEN ACTUATORS OF (N-3) |
| ADDRESS (N-2) | DELAY TIME PERIOD CORRESPONDING TO NUMBER OF DRIVEN ACTUATORS OF (N-2) |
| ADDRESS (N-1) | DELAY TIME PERIOD CORRESPONDING TO NUMBER OF DRIVEN ACTUATORS OF (N-1) |
| ADDRESS (N) | DELAY TIME PERIOD CORRESPONDING TO NUMBER OF DRIVEN ACTUATORS OF (N) |

FIG.14

LIQUID JET APPARATUS, PRINTING APPARATUS, AND METHOD OF ADJUSTING PHASE OF DRIVE PULSE

This application is a continuation of U.S. patent application Ser. No. 11/780,301 filed Jul. 19, 2007 which is incorporated by reference and claimed priority to Japanese application no. 2006-198207 filed Jul. 20, 2006 and Japanese application no. 2007-181649 filed Jul. 11, 2007.

BACKGROUND OF THE INVENTION

1. Technical Field

The present invention relates to a liquid jet apparatus and printing apparatus arranged to print predetermined letters and images by emitting microscopic droplets of liquids from a plurality of nozzles to form the microscopic particles (dots) on a printing medium.

2. Related Art

One example of a printing apparatus currently known in the art is an inkjet printer, which are typically capable of providing high quality color prints at a relatively inexpensive cost. The inkjet printers are widely used, not only in offices, but also by general users along with the widespread popularity of personal computers and digital cameras.

In order to produce a high quality color print in an inkjet printer, it is necessary to print in fine tone. Tone corresponds to the density of each color included in a pixel comprising a liquid dot ejected from the inkjet printer. The size of the liquid dot corresponding to the color density of each pixel is called a tone grade, and the number of the tone grades is called a tone number. A fine tone denotes that there is a large tone number. In order to change the tone grade, it is necessary to modify the drive pulse sent to an actuator provided in the liquid jet head of the inkjet printer. When a piezoelectric element or diaphragm is used as the actuator, since the amount of displacement or distortion of the piezoelectric element increases when the voltage applied to the piezoelectric element increases, the tone grade of the liquid dot can be changed by changing the voltage of the drive pulse.

In one liquid jet head disclosed in Japanese Patent No. JP-A-2003-1824, a plurality of drive pulses with different wave heights are combined and joined before being output to the piezoelectric elements of the nozzles of the same color provided in the liquid jet head. A drive pulse corresponding to the desired tone grade of the liquid dot is selected for every nozzle out of the plurality of drive pulses, and the selected drive pulses are supplied to the piezoelectric elements of the corresponding nozzles. Then droplets of the liquid of different weight are emitted, thereby achieving the desired tone grade.

However, in the inkjet printers currently known in the art, there are difficulties when the phase of the drive pulse is delayed by parasitic inductance, parasitic capacitance, resistance in the wiring of the drive circuit, capacitance of the actuator. Moreover, the amount of phase delay varies in accordance with the number of the actuators driven by the drive pulse. The phase delay in the drive pulse causes delay in the liquid jet emission timing, resulting in variations in the liquid dot forming position (also referred to as a landing position) which leads degradation of the print quality.

Further, when a so-called class-D amplifier, which is a digital power amplifier with little heat generation and power loss, is used as the amplifier of the drive pulses, since the phase characteristic of the low-pass filter varies in accordance with the number of the actuators being driven, and the phase delay increases in accordance with increase in the number of the actuators being driven, and the phase delay described above becomes more apparent.

BRIEF SUMMARY OF THE INVENTION

The present invention has an object of providing a liquid jet apparatus, a printing apparatus, and a method of adjusting a phase a drive pulse for compensating the phase delay of the drive pulse to make the liquid jet emission timing proper.

A first aspect of the invention is a liquid jet apparatus comprising a plurality of nozzles provided to a liquid jet head, an actuator provided corresponding to each of the nozzles, and drive unit that applies a drive pulse to the actuator, wherein the drive unit includes correction value storing unit that stores a drive pulse application timing correction value corresponding to the number of actuators to be driven, and drive pulse application timing correction unit that corrects the drive pulse application timing using the drive pulse application timing correction value corresponding to the number of actuators to be driven stored in the correction value storing unit.

Using the method and apparatus described herein, the phase delay of a drive pulse can be compensated to improve the liquid jet emission timing.

BRIEF DESCRIPTION OF THE DRAWINGS

FIGS. 1A and 1B illustrate the configuration of a line head printing apparatus which is capable of performing aspects of the present invention, wherein FIG. 1A is a top view, and FIG. 1B is a front view;

FIG. 14 is an explanatory diagram of drive pulse application timing correction values corresponding to the number of actuators to be driven stored in the delay time memory shown in FIG. 12;

DESCRIPTION OF EXEMPLARY EMBODIMENTS

An embodiment will be explained with reference to the drawings using a printing apparatus capable of printing letters and images on a print medium by emitting a liquid as an example of the present invention.

Figure 1A:
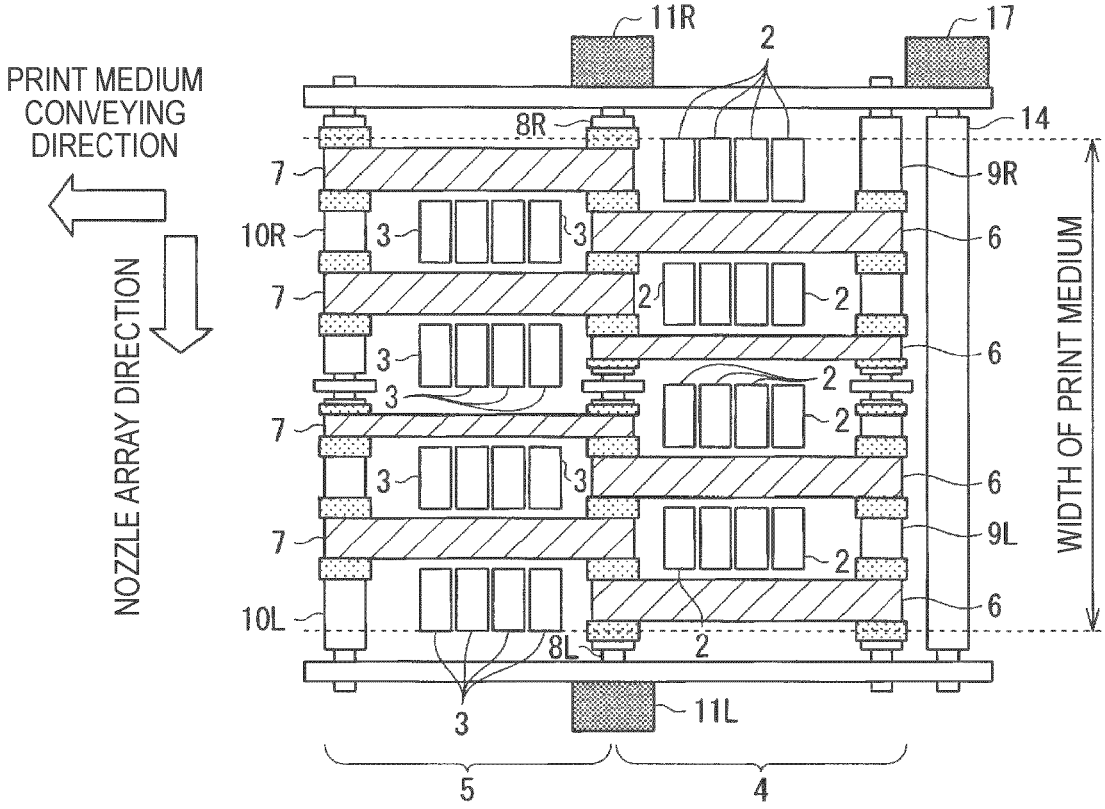
Figure 1B:
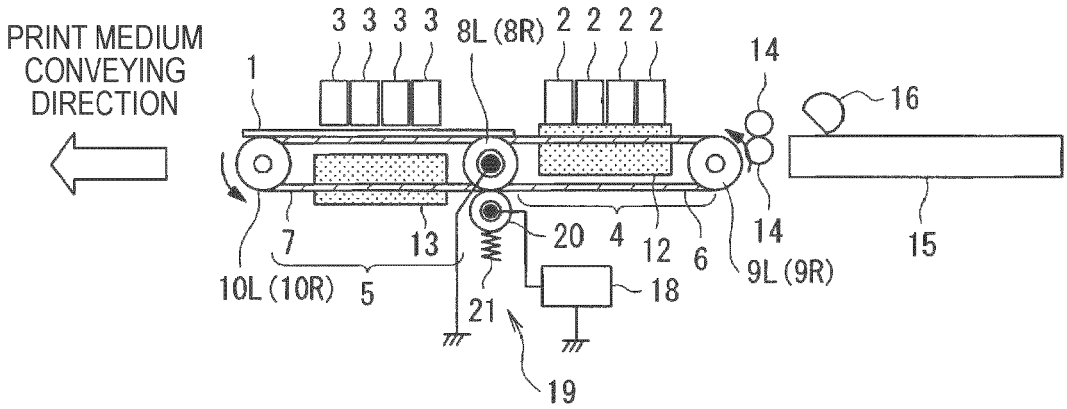

FIGS. 1A and 1B are schematic configuration views of the printing apparatus according to the present embodiment, wherein FIG. 1A is a top view, and FIG. 1B is a front view. In FIGS. 1A and 1B, a print medium 1 is conveyed from the right side of the drawing to the left along the arrow direction, and is printed in a print area. It should be noted that the liquid jet head of the present embodiment is not disposed integrally in one place, but is disposed separately in two places.

The reference numeral 2 in the drawing denotes a first liquid jet head disposed on the upstream side in the conveying direction of the print medium 1, while the reference numeral 3 denotes a second liquid jet head disposed downstream side in the conveying direction. A first conveying section 4 for conveying the print medium 1 is disposed below the first liquid jet head 2, and a second conveying section 5 is disposed below the second liquid jet head 3. The first conveying section 4 is composed of four first conveying belts 6 disposed at predetermined intervals in the direction traversing the conveying direction of the print medium 1, which is hereinafter also referred to as the nozzle array direction. The second conveying section 5 is similarly composed of four second conveying belts 7, which are disposed at predetermined intervals in the nozzle array direction.

The four first conveying belts 6 and the similar four second conveying belts 7 are disposed adjacent to each other in an alternating configuration. In the present embodiment, the two first and second conveying belts 6 and 7 in the right side in the nozzle array direction are distinguished from the two first and second conveying belts 6 and 7 in the left side in the nozzle array direction. In other words, an overlapping portion of the two of the first and second conveying belts 6 and 7 in the right side are provided with a right side drive roller 8R and an overlapping portion of the two of the first and second conveying belts 6 and 7 are provided with a left side drive roller 8L. A right side first driven roller 9R and left side first driven roller 9L are disposed in the upstream direction, and a right side second driven roller 10R and left side second driven roller 10L are disposed in the downstream direction. Although these rollers may seem a series of rollers, actually they are decoupled at the center portion of FIG. 1A.

Further, the two first conveying belts 6 of the right side are wound around the right side drive roller 8R and the right side first driven roller 9R, while the two first conveying belts 6 in the left side are wound around the left side drive roller 8L and the left side first driven roller 9L. The two second conveying belts 7 of the right side are wound around the right side drive roller 8R and the right side second driven roller 10R, and the two second conveying belts 7 on the left side are wound around the left side drive roller 8L and the left side second driven roller 10L. Further, a right side electric motor 11R is connected to the right side drive roller 8R, and a left side electric motor 11L is connected to the left side drive roller 8L. Therefore, when the right side electric motor 11R rotationally drives the right side drive roller 8R, the first conveying section 4 being composed of the two first conveying belts 6 on the right side and the second conveying section 5 composed of the two second conveying belts 7 on the right side move in sync with each other and at the same speed. The left side electric motor 11L rotationally drives the left side drive roller 8L, the first conveying section 4 being composed of the two first conveying belts 6 of the left side. Similarly, the second conveying section 5 composed of the two second conveying belts 7 of the left side move in sync with each other and at the same speed.

It should be noted that by arranging the rotational speeds of the right side electric motor 11R and the left side electric motor 11L to be different from each other, the conveying speeds in the left and right in the nozzle direction can be set to be different from each other. More specifically, by assigning the right side electric motor 11R a higher rotation speed than the left side electric motor 11L, the conveying speed in the right side in the nozzle array direction can be made higher than that in the left side, and by assigning the left side electric motor 11L a higher rotation speed than the right side electric motor 11R, the conveying speed of the left side can be faster than that in the right side.

The first liquid jet head 2 and the second liquid jet head 3 are disposed with a plurality of colors, including, for example, yellow (Y), magenta (M), cyan (C), and black (K), which are arranged as a unit in the conveying direction of the print medium 1. The liquid jet heads 2, 3 are supplied with liquids from liquid tanks of respective colors (not shown) via liquid supply tubes. Each of the liquid jet heads 2 and 3 are provided with a plurality of nozzles which are formed in the nozzle array direction, which is perpendicular to the conveying direction of the print medium 1, and by emitting a necessary amount of the liquid jet from the respective nozzles simultaneously to the necessary positions, microscopic liquid dots are formed on the print medium 1. By performing the process described above, one-pass printing can be achieved with the print medium 1 being conveyed by the first and second conveying sections 4 and 5 in a single pass. In other words, the area in which the liquid jet heads 2 and 3 are disposed corresponds to the print area.

As may be understood by one of ordinary skill in the art, various methods of emitting liquid jets from each of the nozzles of the liquid jet heads may be used, including an electrostatic method, a piezoelectric method, a film boiling jet method, and the like. In the electrostatic method, when a drive signal is provided to an electrostatic gap which acts as an actuator, a diaphragm in a cavity is displaced to cause pressure variation in the cavity, and the liquid jet is emitted from the nozzle in accordance with the pressure variation. In the piezoelectric method, when a drive signal is provided to a piezoelectric element acting as an actuator, a diaphragm in a cavity is displaced to cause pressure variation in the cavity, and the liquid jet is emitted from the nozzle in accordance with the pressure variation. In the film boiling jet method, a microscopic heater is provided in the cavity, and is instantaneously heated to be at a temperature of 300° C. or higher causing the liquid to reach a film boiling state where bubbles are generated, thus causing the pressure variation making the liquid jet be emitted from the nozzle. The present invention can apply to any of these liquid jet methods, but it is particularly preferable to use a piezoelectric element capable of adjusting an amount of the liquid ejected by controlling the wave height or gradient of increase or decrease in the voltage of the drive signal.

The liquid jet emission nozzles of the first liquid jet head 2 are only provided between the four first conveying belts 6 of the first conveying section 4, the liquid jet emission nozzles of the second liquid jet head 3 are only provided between the four second conveying belts 7 of the second conveying section 5. During a cleaning process described more fully below, the liquid jet heads 2 and 3 are not properly aligned to perform one-pass printing. During the printing process, however, the first liquid jet head 2 and the second liquid jet head 3 are shifted in the conveying direction of the print head 1 in order to compensating for each other's unprintable areas.

Below the first liquid jet head 2, a first cleaning cap 12 is disposed for cleaning the first liquid jet head 2. Similarly, a second cleaning cap 13 for cleaning the second liquid jet head 3 is disposed below the second liquid jet head 3. Each of the cleaning caps 12 and 13 are formed to have a size which allows the cleaning caps to pass between the four first conveying belts 6 of the first conveying section 4 and between the four second conveying belts 7 of the second conveying section 5. Each of the cleaning caps 12 and 13 are composed of a cap body having a rectangular shape with a bottom, which is capable of covering the nozzles provided to the lower surface, namely a nozzle surfaces of the liquid jet head 2 and 3 and adhering to the nozzle surfaces. A liquid absorbing body is disposed at the bottom of each of the cleaning caps 12 and 13 with a peristaltic pump connected to the bottom of the cap body, and an elevating device for moving the cap body up and down. Then, the cap body is moved up by the elevating device to be adhered to the nozzle surface of the liquid jet head 2 and 3. By creating a negative pressure in the cap body using the peristaltic pump, any residual liquid or bubbles are suctioned from the nozzle openings on the nozzle surface of the liquid jet head 2 and 3, thus the cleaning of the liquid jet head 2 and 3 can be performed. After the cleaning is completed, each of the cleaning caps 12 and 13 is are removed from the liquid jet heads 2 and 3.

On the upstream side of the first driven rollers 9R, 9L, a pair of gate rollers 14 for adjusting the feed timing of the print medium 1 from a feeder section 15 and correcting the skew of the print medium 1 are disposed. The skew denotes any turn or alignment variation of the print medium 1 with respect to the conveying direction. Further, above the feeder section 15, there is provided a pickup roller 16 for feeding the print medium 1. It should be noted that the reference numeral 17 in the drawing denotes a gate roller motor for driving the gate rollers 14.

A belt charging device 19 is disposed below the drive rollers 8R and 8L. The belt charging device 19 is composed of a charging roller 20 having a contact with the first conveying belts 6 and the second conveying belts 7 via the drive rollers 8R and 8L. A spring 21 presses the charging roller 20 against the first conveying belts 6 and the second conveying belts 7, and a power supply 1 applies a charge to the charging roller 20 and subsequently to the first conveying belts 6 and the second conveying belts 7 by the transfer of charge from the charging roller 20. Since the belts are generally made of a moderate or high resistivity material or an insulating material, when they are charged by the belt charging device 19, the charge applied on the surface thereof causes the print medium 1 made similarly of a high resistivity material or an insulating material to have dielectric polarization, and the print medium 1 can be attracted to the belt by the electrostatic force caused between the charge generated by the dielectric polarization and the charge on the surface of the belt. It should be noted that as the belt charging unit, a corotron for showering the charges can also be used.

Therefore, according to the present printing apparatus, when the surfaces of the first conveying belts 6 and the second conveying belts 7 are charged by the belt charging device 19, the print medium 1 is fed from the gate roller 14 in that state, and the print medium 1 is pressed against the first conveying belts 6 by a sheet pressing roller composed of a spur or a roller (not shown), the print medium 1 is attracted to the surfaces of the first conveying belts 6 under the action of dielectric polarization. In this state, when the electric motors 11R and 11L rotationally drive the drive rollers 8R and 8L, the rotational drive force is transmitted to the first driven rollers 9R and 9L via the first conveying belts 6.

Thus, the first conveying belts 6 move toward the downstream side of the conveying direction while attracting the print medium 1. Printing is performed by emitting liquid jets from the nozzles formed on the first liquid jet head 2 while moving the print medium 1 to below the first liquid jet head 2. When the printing by the first liquid jet head 2 is completed, the print medium 1 is moved downstream in the conveying direction and is transferred to the second conveying belts 7 of the second conveying section 5. As described above, since the second conveying belts 7 are also provided with the charge on the surface thereof by the belt charging device 19, the print medium 1 is attracted to the surfaces of the second conveying belts 7 under the action of the dielectric polarization.

In the present state, the second conveying belts 7 are moved to the downstream side of the conveying direction, printing is performed by emitting liquid jets from the nozzles formed on the second liquid jet head 3 while moving the print medium 1 below the second liquid jet head 3. After the printing by the second liquid jet head is completed, the print medium 1 is moved further to the downstream side of the conveying direction, where the print medium 1 is ejected to a catch tray while separating it from the surfaces of the second conveying belts 7 by a separating device not shown in the drawings.

Further, in order to clean the first and second liquid ejection heads 2 and 3, the first and second cleaning caps 12 13 are raised to so as to seal the nozzle surfaces of the first and second liquid jet heads 2 and 3. The cleaning is performed by applying negative pressure to the inside of the caps in order to remove any residual liquid and/or bubbles from the nozzles of the first and second liquid jet heads 2 and 3. After the cleaning process is completed, the first and second cleaning caps 12 and 13 are moved down from the nozzle surfaces.

Figure 2:
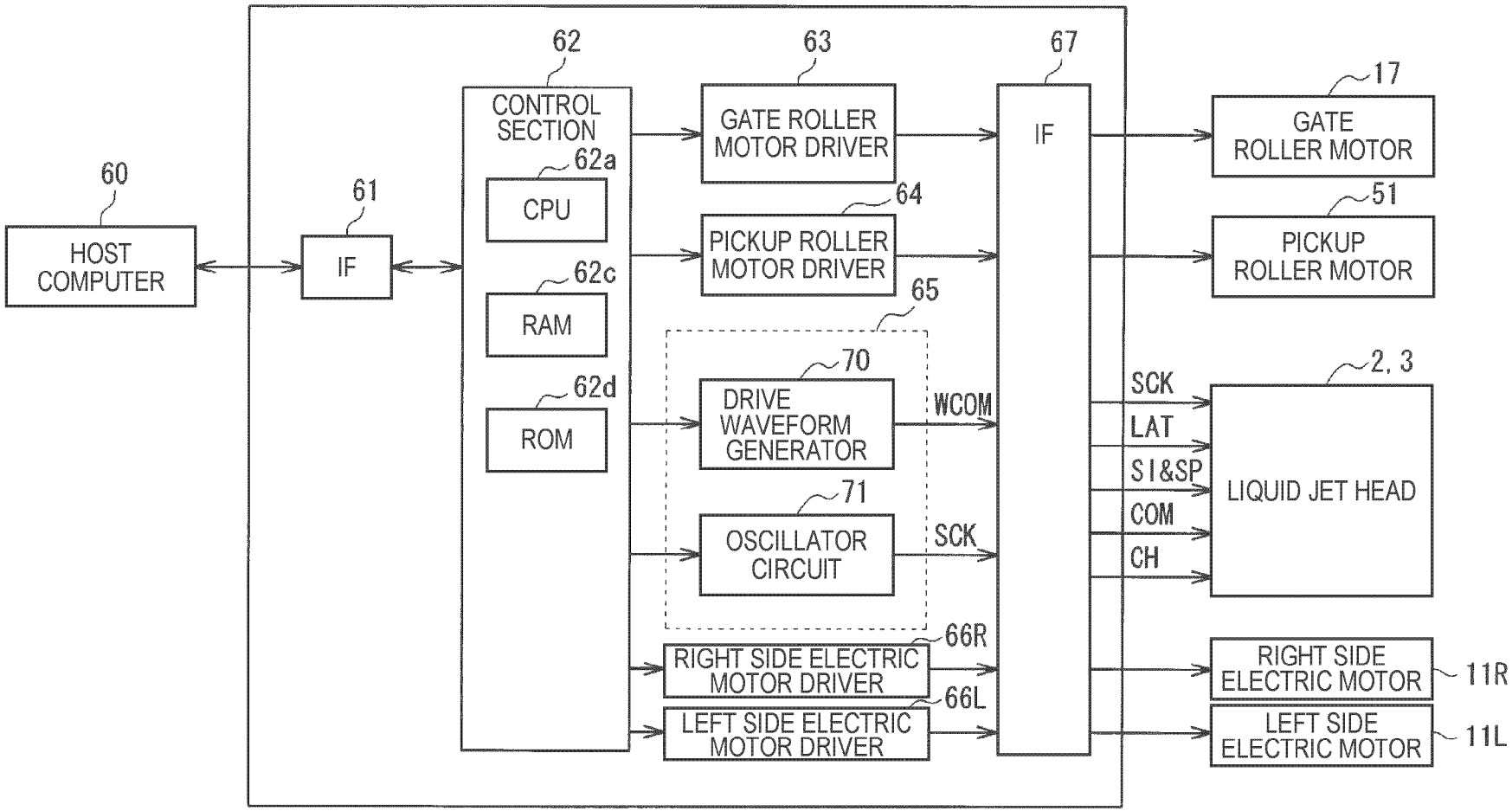
FIG. 2 is a block diagram of a control device of the printing apparatus shown in FIGS. 1A and 1B.

A control device capable of controlling the device is disposed inside the printing apparatus. The control device is, as shown in FIG. 2, capable of controlling the printing apparatus, the feeder device, and so on based on print data which is input from a host computer 60 (such as a personal computer or a digital camera), in order to perform a printing process on the print medium. Further, the control device is configured to include an input interface section 61 for receiving print data input from the host computer 60, a control section 62 formed of a microcomputer for performing the printing process based on the print data input from the input interface section 61, a gate roller motor driver 63 for driving the gate roller motor 17, a pickup roller motor driver 64 for driving a pickup roller motor 51, which also drives the pickup roller 16, a head driver 65 for driving the liquid jet heads 2 and 3, a right side electric motor driver 66R for driving the right side electric motor 11R, a left side electric motor driver 66L for driving the left side electric motor 11L, and an interface 67 for converting the output signals of the drivers 63-65, 66R, and 66L into control signals used by the gate roller motor 17, the pickup roller motor 51, the liquid jet heads 2 and 3, the right side electric motor 11R, and the left side electric motor 11L.

The control section 62 is provided with a central processing unit (CPU) 62*a* for performing a various processes such as the printing process, a random access memory (RAM) 62*c* for temporarily storing the print data input via the input interface 61 and various kinds of data used in performing the printing process, and for temporarily developing an application program which may be used in the printing process, and a read-only memory (ROM) 62*d* formed of a nonvolatile semiconductor memory which is capable of storing the control program executed by the CPU 62*a* and so on. When the control section 62 receives the print data (image data) from the host computer 60 via the interface section 61, the CPU 62*a* performs a predetermined process on the print data in order to output printing data (drive pulse selection data SI&SP) regarding which nozzle emits the liquid jet and how much liquid jet is emitted, and further outputs the control signals to the respective drivers 63-65, 66R, and 66L based on the printing data and the input data received from the various sensors. When the control signals are output from the respective drivers 63-65, 66R, and 66L, the control signals are converted by the interface section 67 into the drive signals, the actuators corresponding to a plurality of nozzles of the liquid jet heads, the gate roller motor 17, the pickup roller motor 51, the right side electric motor 11R, and the left side electric motor 11L each respectively operate, causing the print medium 1 to be fed and conveyed through the device during the printing process. It should be noted that the elements inside the control section 62 are electrically connected to each other via a bus (not shown).

Further, in order to write the waveform forming data DATA which is used for forming the drive signal described later in the waveform memory 701, the control section 62 outputs a write enable signal DEN, a write clock signal WCLK, and write address data A0 through A3 to write the 16 bit waveform forming data DATA into the waveform memory 701. In addition, the control section 62 also outputs the read address data A0 through A3 for reading the waveform forming data DATA stored in the waveform memory 701, a first clock signal ACLK for setting the timing for latching the waveform forming data DATA retrieved from the waveform memory 701, a second clock signal BCLK for setting the timing for adding the latched waveform data, and a clear signal CLER for clearing the latched data to the head driver 65.

Figure 3:
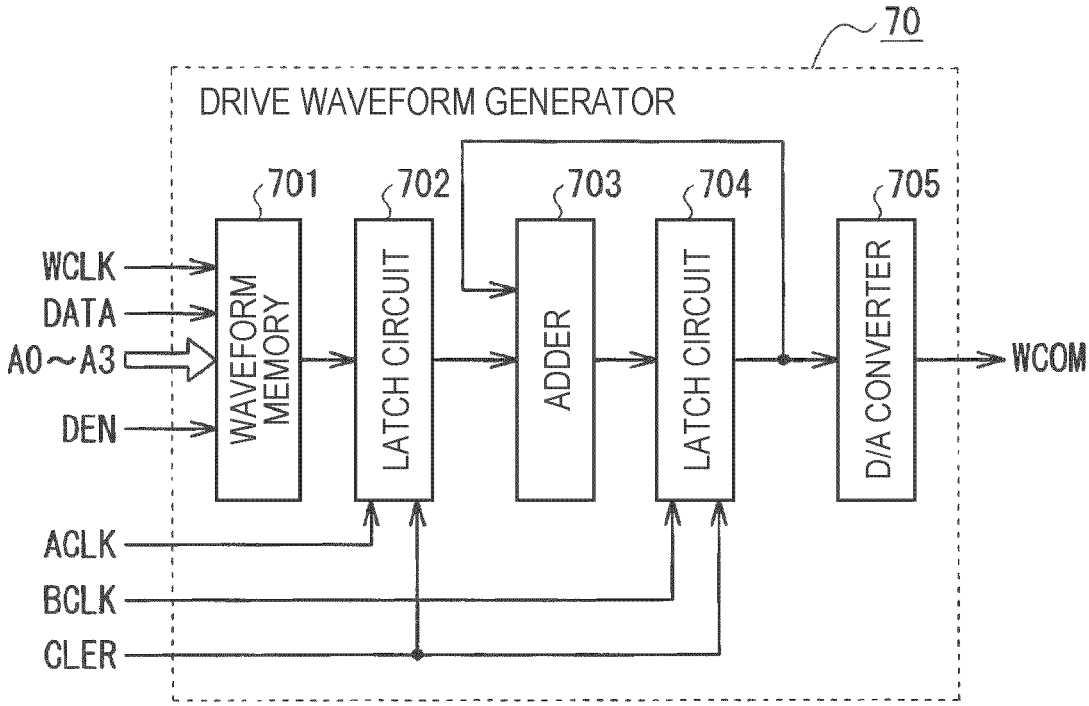
FIG. 3 is a block configuration diagram of the drive waveform signal generation circuit shown in FIG. 2.

The head driver 65 is provided with a drive waveform generator 70 for forming a drive waveform signal WCOM and an oscillator circuit 71 for outputting a clock signal SCK. The drive waveform generator 70 is provided, as shown in FIG. 3, with the waveform memory 701 for storing the waveform forming data DATA for forming the drive waveform signal input from the control section 62 in the storage element at a predetermined address, a latch circuit 702 for latching the waveform forming data DATA retrieved from the waveform memory 701 in accordance with the first clock signal ACLK described above, an adder 703 for adding the output of the latch circuit 702 with the waveform generation data WDATA output from a latch circuit 704 as described more fully below, the latch circuit 704 for latching the added output of the adder 703 in accordance with the second clock signal BCLK, and a D/A converter 705 for converting the waveform generation data WDATA output from the latch circuit 704 into an analog signal. Then, the clear signal CLER output from the control section 62 is sent to the latch circuits 702, 704, and when the clear signal CLER is turned to the off state, the latched data is cleared.

Figure 4:
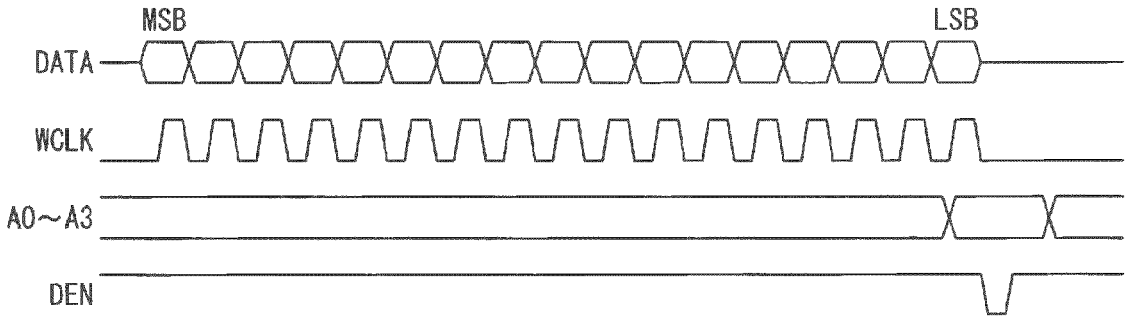
FIG. 4 is an explanatory diagram of the waveform memory shown in FIG. 3.

The waveform memory 701 is provided, as shown in FIG. 4, with a several bits of memory elements arranged in each designated address, and the waveform data DATA is stored together with the address A0 through A3. Specifically, the waveform data DATA is input in accordance with the clock signal WCLK with respect to the address A0 through A3 designated by the control section 62, and the waveform data DATA is stored in the memory elements in response to receipt of the write enable signal DEN.

Subsequently, the principle of generating the drive waveform signal by the drive waveform generator 70 will be explained. Firstly, waveform data of zero is written in the address A0 as an amount of voltage variation per unit time period. Similarly, the waveform data of +ΔV1 is written in the address A1, the waveform data of −ΔV2 is written in the address A2, and the waveform data of +ΔV3 is written in the address A3, respectively. Further, the stored data in the latch circuits 702, 704 is cleared by the clear signal CLER. Further, the drive waveform signal WCOM is raised to an intermediate voltage potential (offset) by the waveform data.

Figure 5:
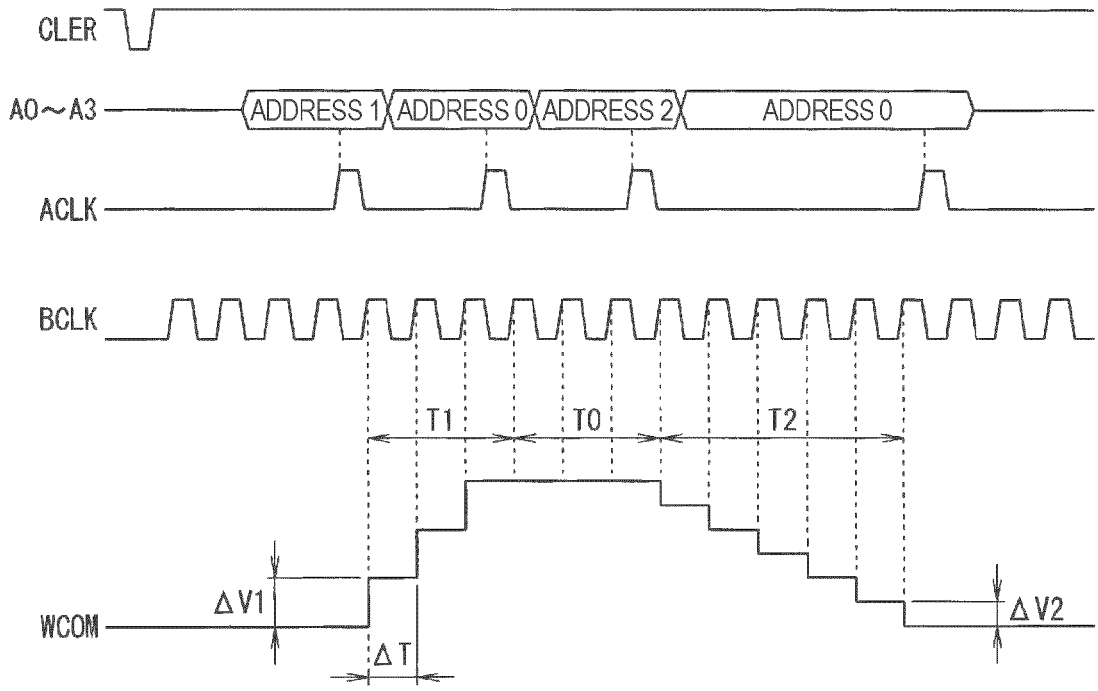
FIG. 5 is an explanatory diagram of generation of the drive waveform signal.

When the waveform data in the address A1 is retrieved and the first clock signal ACLK is input as shown in FIG. 5, the digital data of +ΔV1 is stored in the latch circuit 702. The stored digital data of +ΔV1 is input to the latch circuit 704 via the adder 703, the output of the adder 703 is stored, and in the latch circuit 704 in sync with the rising of the second clock BCLK. Since the output of the latch circuit 704 is also input to the adder 703, the output of the latch circuit 704, namely the drive waveform signal WCOM, is added with +ΔV1 with every rising timing of the second clock BCLK. In the present example, the waveform data in the address of A1 is retrieved for a time interval of T1, and as a result, the digital data of +V1 is added three times during the T1 time interval, resulting in data which is three times as large as +ΔV1.

Subsequently, when the waveform data in the address A0 is retrieved, and in addition, the first clock ACLK is input, the digital data stored in the latch circuit 702 is switched to zero. Although this digital data of zero is, as described above, added through the adder 703 with the rising timing of the second clock signal BCLK, since the digital data is zero, the previous value is actually maintained. In the present example, the drive waveform signal WCOM is maintained at a constant value for the time period of T0.

Subsequently, when the waveform data in the address A2 is retrieved, and the first clock signal ACLK is input, the digital data stored in the latch circuit 702 is switched to −ΔV2. Although the digital data of −ΔV2 is, as described above, added through the adder 703 with the rising timing of the second clock signal BCLK, since the digital data is −ΔV2, the drive waveform signal WCOM is actually subtracted by an amount corresponding to −ΔV2 in accordance with the second clock signal. In the present embodiment, the digital data is subtracted six times during the time period of T2 until the digital data becomes −6ΔV2.

Figure 6:
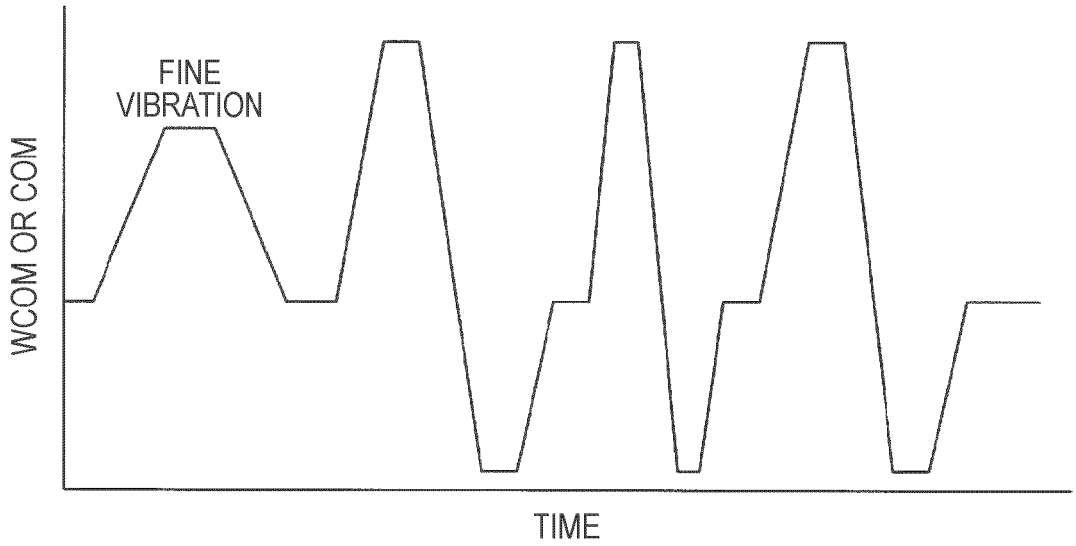
FIG. 6 is an explanatory diagram of the drive waveform signal or the drive signal connected in a time-series manner.
Figure 7:
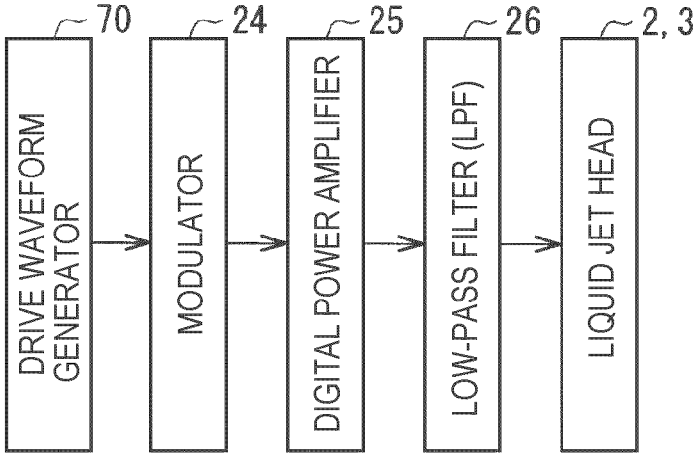
FIG. 7 is a block configuration diagram of a drive signal output circuit.

By performing the analog conversion by the D/A converter 705 on the digital signal, the drive waveform signal WCOM composed of a plurality of trapezoidal voltage waves can be obtained, as shown in FIG. 6. By performing a power amplification process using the drive signal output circuit shown in FIG. 7 on the above signal, and supplying it to the liquid jet heads 2 and 3 as the drive signal COM, it is possible to drive the actuator provided to each of the nozzles, thus the liquid jet can be emitted from each of the nozzles. The drive signal output circuit is configured to include a modulator 24 for performing pulse width modulation on the drive waveform signal WCOM generated by the drive waveform generator 70, a digital power amplifier 25 for performing power amplification on the modulated (PWM) signal on which the pulse width modulation is performed by the modulator 24, and a low-pass filter 26 for smoothing the modulated (PWM) signal amplified by the digital power amplifier 25. The drive signal output circuit will be described in greater detail below.

The rising portion of the drive signal COM corresponds to the period when the capacity of the cavity (pressure chamber) communicating the nozzle is expanded to pull in the liquid from the nozzles, or more specifically, the meniscus is pulled in from the emission surface of the liquid. Conversely, the falling portion of the drive signal COM corresponds to a period when the capacity of the cavity is reduced, causing the liquid to be pushed from the nozzles, or more specifically, the meniscus of the liquid is pushed out beyond the emission surface, and a liquid jet is emitted from the nozzle. The series of waveform signals which pull and push out the liquid form the drive pulse, and the drive signal COM is assumed to be formed by linking a plurality of drive pulses. Incidentally, the waveform of the drive signal COM or of the drive waveform signal WCOM can be, as easily inferred from the above description, adjusted by modifying the waveform data 0, +ΔV1, −ΔV2, and +ΔV3 stored in the addresses A0 through A3, the first clock signal ACLK, the second clock signal BCLK. Further, although the first clock signal ACLK is called a clock signal for the sake of convenience, actually, the output timing of the signal can freely be adjusted by an arithmetic process described more fully below.

By changing the gradient of increase and decrease in voltage and the height of the drive pulse of the trapezoidal voltage wave, the amount and speed that the liquid is pulled and pushed from the nozzles can be changed, thus the amount of liquid ejected from the nozzles can be changed to obtain a different size of the liquid dot. Therefore, as shown in FIG. 6, in the case in which a plurality of drive pulses are sequentially joined to form the drive signal COM, it is possible that the single drive pulse is selected from such drive pulses to supply the actuator to emit the liquid, or a plurality of drive pulses may be selected and supplied to the actuator to emit the liquid jet a number of times, thus forming liquid dots of various sizes. In other words, when a number of liquid droplets land on the same position before the liquid has time to dry, it brings substantially the same result as emitting a larger droplet of the liquid, thus the size of the liquid dot can be enlarged. By combining such technologies, fine tone printing can be achieved. It should be noted that the drive pulse shown in the left end of FIG. 6 is only for pulling in the liquid from the nozzle and not for pushing out the liquid. This is called fine vibration, and is used for preventing the nozzle from drying without emitting the liquid from the nozzle.

As a result of the above, the liquid jet heads 2 and 3 are provided with the drive signal COM generated by the drive signal output circuit, the drive pulse selection data SI&SP for selecting the nozzle which emits the liquid and determining the connection timing of the actuator to the drive signal COM based on the print data, the latch signal LAT and a channel signal CH for connecting the drive signal COM and the actuator of the liquid jet heads 2 and 3 so that the drive pulse can be applied to the actuators based on the drive pulse selection data SI&SP after the nozzle selection data is input to all of the nozzles, and the clock signal SCK for transmitting the drive pulse selection data SI&SP to the liquid jet heads 2 and 3, the signals being input as a serial signal.

Figure 8:
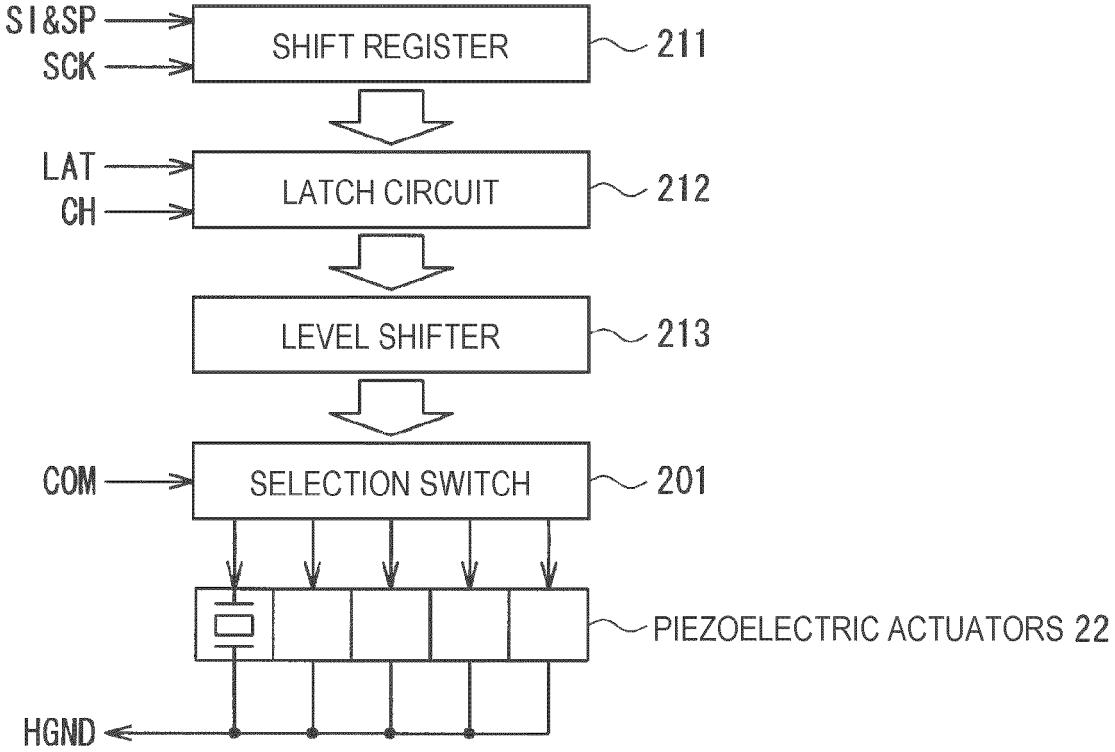
FIG. 8 is a block diagram of a selection section for connecting the drive signal to an actuator.

Subsequently, the configuration for connecting the drive signals COM output from the drive signal output circuit to the actuator will be explained. FIG. 8 is a block diagram of the selection section for connecting the drive signals COM to the piezoelectric actuators 22 or other piezoelectric element. The selection section is composed of a shift register 211 for storing the drive pulse selection data SI&SP which designates the piezoelectric actuator 22 as a nozzle from which the liquid is to be emitted, a latch circuit 212 for temporarily storing the data of the shift register 211, a level shifter 213 for performing level conversion on the output of the latch circuit 212, and a selection switch 201 for connecting the drive signal COM to the piezoelectric actuator 22 in accordance with the output of the level shifter.

The drive pulse selection data SI&SP is sequentially input to the shift register 211, and at the same time, the storage area is sequentially shifted from the first stage to the subsequent stage in accordance with the input pulse of the clock signal SCK. The latch circuit 212 latches the output signals of the shift register 211 in accordance with the input latch signal LAT after the drive pulse selection data SI&SP corresponding to the number of the nozzles being driven is stored in the register 211. The signals stored in the latch circuit 212 are converted to a voltage level capable of switching on and off the selection switch 201 on the subsequent stage by the level shifter 213. This is because the drive signal COM has a higher voltage than the output voltage of the latch circuit 212, and the operating voltage range of the selection switch 210 is also set to be higher than the output voltage of the latch circuit 212. Therefore, the selection switch 201 of the piezoelectric actuator 22 which is closed by the level shifter 213 is connected to the drive signal COM with the connection timing of the drive pulse selection data SI&SP. Further, after the drive pulse selection data SI&SP of the shift register 211 is stored in the latch circuit 212, the subsequent drive pulse data SI&SP is input to the shift register 211, and the stored data of the latch circuit 212 is sequentially updated with the liquid jet emission timing. It should be noted that the reference HGND in the drawings denotes the ground terminal for the piezoelectric actuator 22. Further, according to the selection switch 201, even after the piezoelectric actuator 22 stops receiving the drive signal COM, the input voltage of the piezoelectric actuator 22 is maintained at the voltage level established immediately before it stops receiving the drive signal COM.

Figure 9:
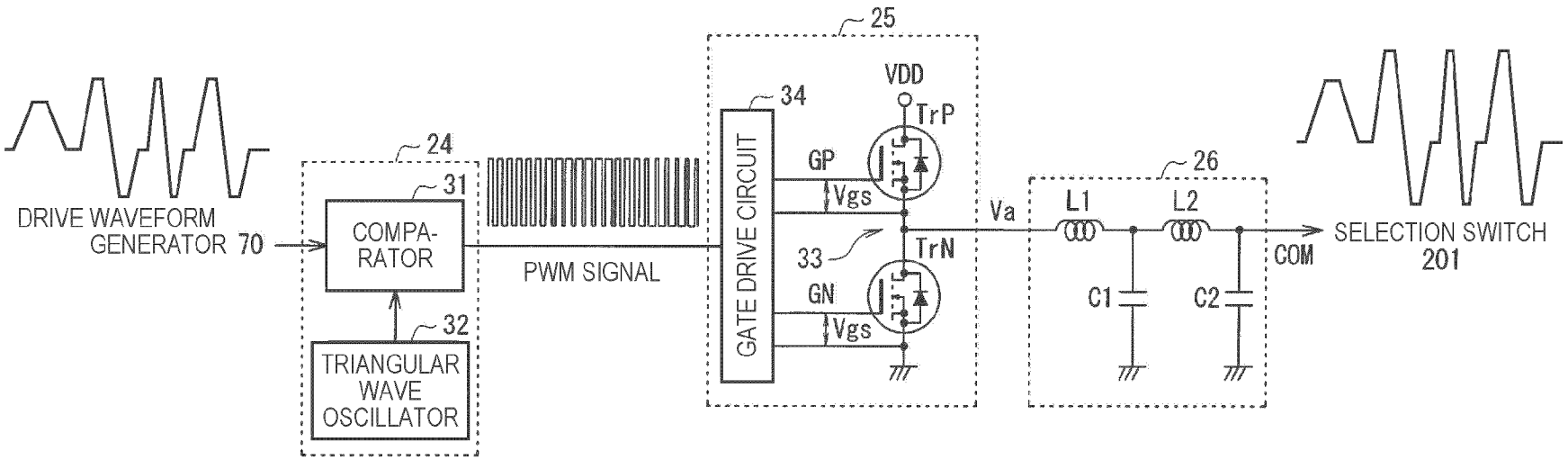
FIG. 9 is a block diagram showing details of the modulation circuit, the digital power amplifier, and the low-pass filter of the drive signal output circuit shown in FIG. 7.
Figure 10:
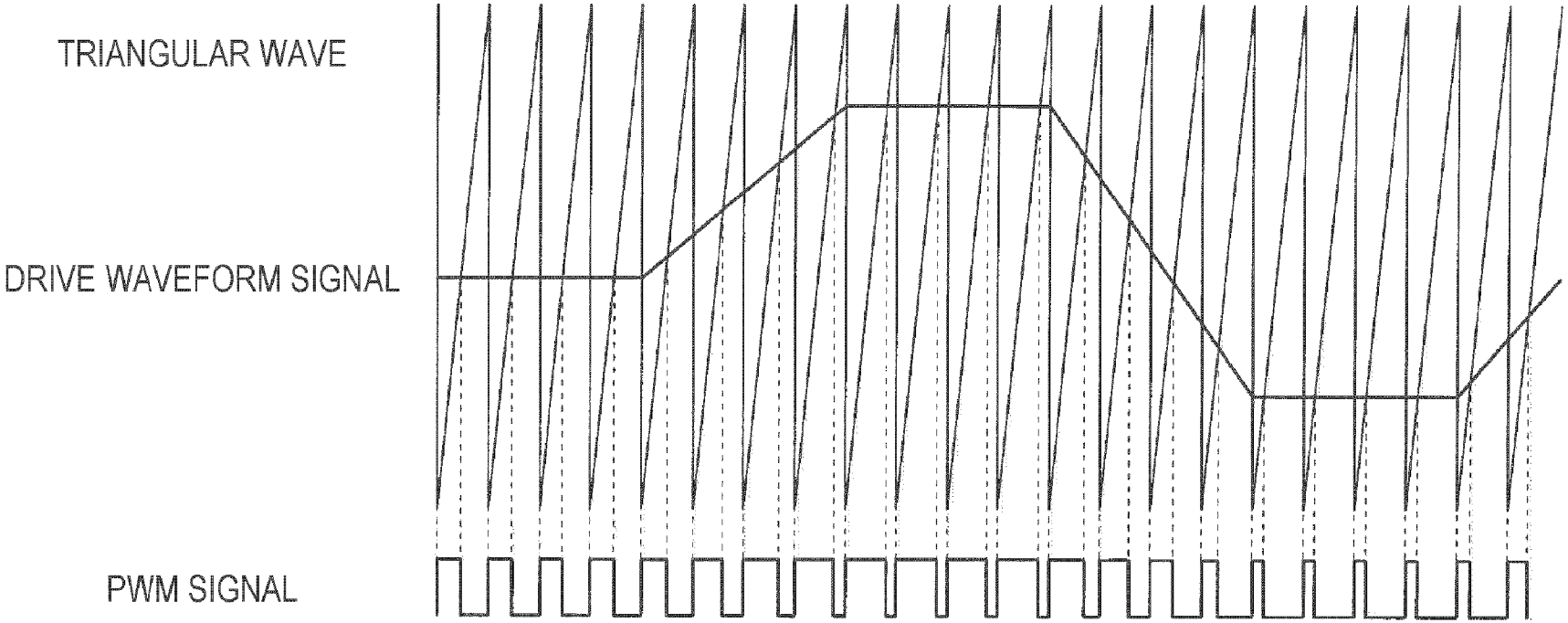
FIG. 10 is an explanatory diagram of the operation of the modulation circuit shown in FIG. 9.

FIG. 9 shows a specific configuration of the drive signal output circuit of the modulator 24 for sending a drive signal to the low-pass filter 26. A common pulse width modulation (PWM) circuit is used a the modulator 24 for performing a pulse width modulating process on the drive waveform signal WCOM. The modulator 24 is composed of a well-known triangular wave oscillator 32, and a comparator 31 for comparing the triangular wave output from the triangular wave oscillator 32 with the drive waveform signal WCOM. As shown in FIG. 10, the modulator 24 outputs a modulated (PWM) signal, which is set to HIGH level when the drive waveform signal WCOM exceeds the triangular wave and is set to LOW level when the drive waveform signal WCOM is lower than the triangular wave. It should be noted that although a pulse width modulation circuit is used as the pulse modulator in the present embodiment, a pulse density modulation (PDM) circuit can also be used.

Figure 11:
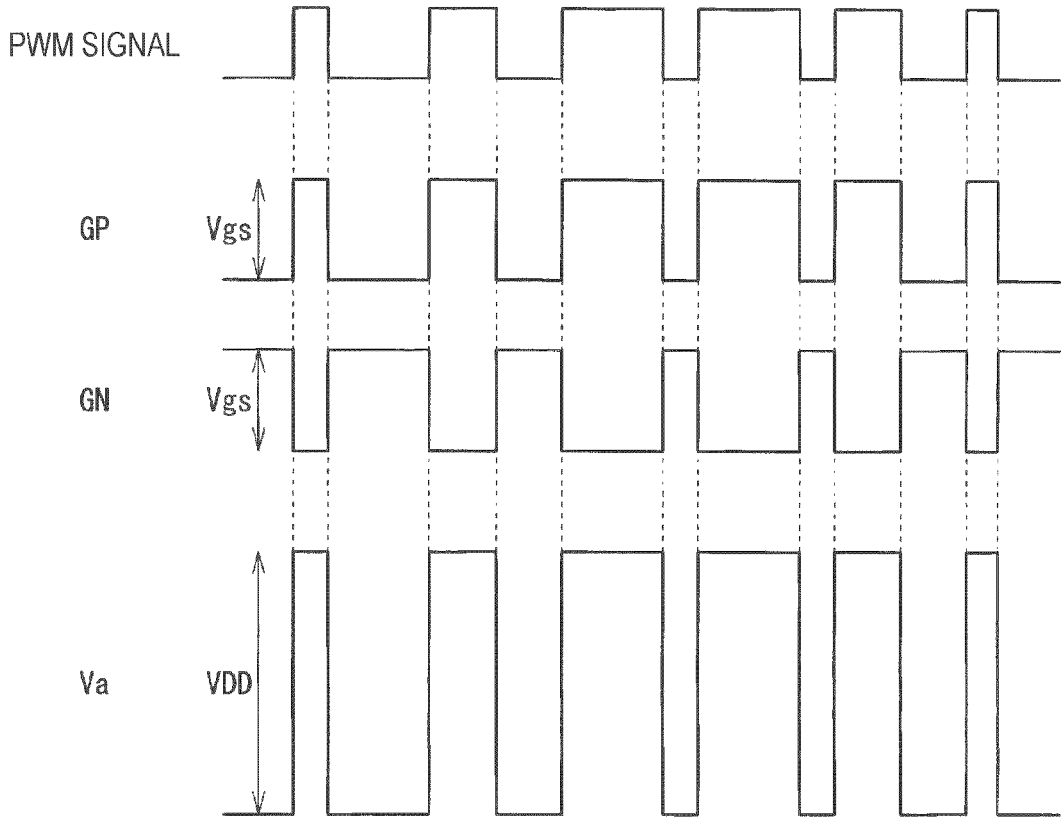
FIG. 11 is an explanatory diagram of the operation of the digital power amplifier shown in FIG. 9.

The digital power amplifier 25 is configured to include a half-bridge driver stage 33 composed of two MOSFETs, TrP and TrN, for substantially amplifying the power, and a gate drive circuit 34 for controlling the gate-source signals GP and GN of the MOSFETs TrP and TrN based on the modulated (PWM) signal from the modulator 24. The half-bridge driver stage 33 is formed by combining the high-side MOSFET TrP and the low-side MOSFET TrN in a push-pull manner. Assuming that the gate-source signal of the high-side MOSFET TrP is GP, the gate-source signal of the low-side MOSFET TrN is GN, and the output of the half-bridge driver stage 33 is Va, FIG. 11 shows how these signals vary in accordance with the modulated (PWM) signal. It should be noted that the voltage values Vgs of the gate-source signals GP and GN of the respective MOSFETs TrP and TrN are assumed to be sufficient to turn the MOSFETs TrP and TrN.

When the modulated (PWM) signal is at the HIGH level, the gate-source signal GP of the high-side MOSFET TrP is set to the HIGH level while the gate-source signal GN of the low-side MOSFET TrN is set to the LOW level, the high-side MOSFET TrP is turned ON, while the low-side MOSFET TrN is turned OFF, and as a result, the output Va of the half-bridge driver state 33 is the supply voltage VDD. On the other hand, when the modulated (PWM) signal at the LOW level, the gate-source signal GP of the high-side MOSFET TrP is set to the LOW level while the gate-source signal GN of the low-side MOSFET TrN is set to the HIGH level, the high-side MOSFET TrP is turned OFF while the low-side MOSFET TrN is turned ON, and as a result, the output Va of the half-bridge driver state 33 becomes zero.

The output Va of the half-bridge driver stage 33 of the digital power amplifier 25 is supplied to the selection switch 201 as the drive signal COM via the low-pass filter 26. The low-pass filter 26 is formed of a low-pass filter composed of a combination of two coils L1 and L2, and two capacitors C1 and C2. The low-pass filter 26 formed of the low pass filter is designed to sufficiently attenuate the high frequency component of the output Va of the half-bridge driver stage 33 of the digital power amplifier 25. More specifically, the low-pass filter is designed to attenuate the power amplified modulated (PWM) signal component, while not attenuating the drive signal component COM (or alternatively, the drive waveform component WCOM).

As described above, when the MOSFETs TrP and TrN of the digital power amplifier 25 are driven in a digital manner, since the MOSFETs act as switch elements, although the current flows in each MOSFET when the MOSFET is ON, the drain-source resistance is extremely small, meaning that there is very little power loss. Further, since no current flows when the MOSFETs are in the OFF state, there is no power loss. Therefore, the power loss of the digital power amplifier 25 is extremely small, the small-sized MOSFET can be used, and a cooling unit such as a heat radiation plate which is typically needed for cooling can be eliminated. Incidentally, when the transistor is driven in the linear range, the resulting efficiency is about 30%, while the efficiency of digital power amplifier is 90% or higher. Further, since the heat radiation plate for cooling the transistor requires about 60 mm square in size for each transistor, when the radiation plate can be eliminated, there are overwhelming advantages in the actual layout of the device.

Figure 12:
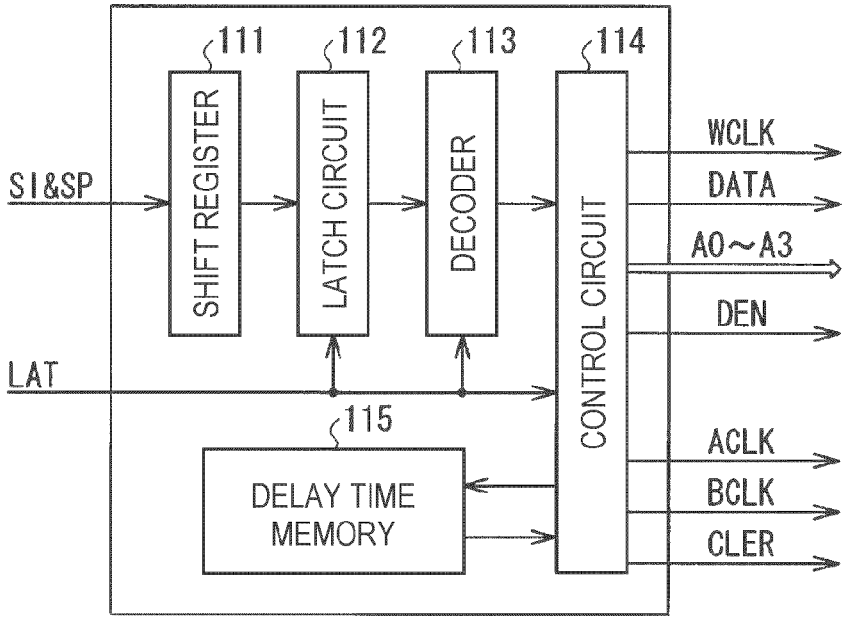
FIG. 12 is a block diagram showing an output circuit for a clock signal shown in FIG. 3.
Figure 15:
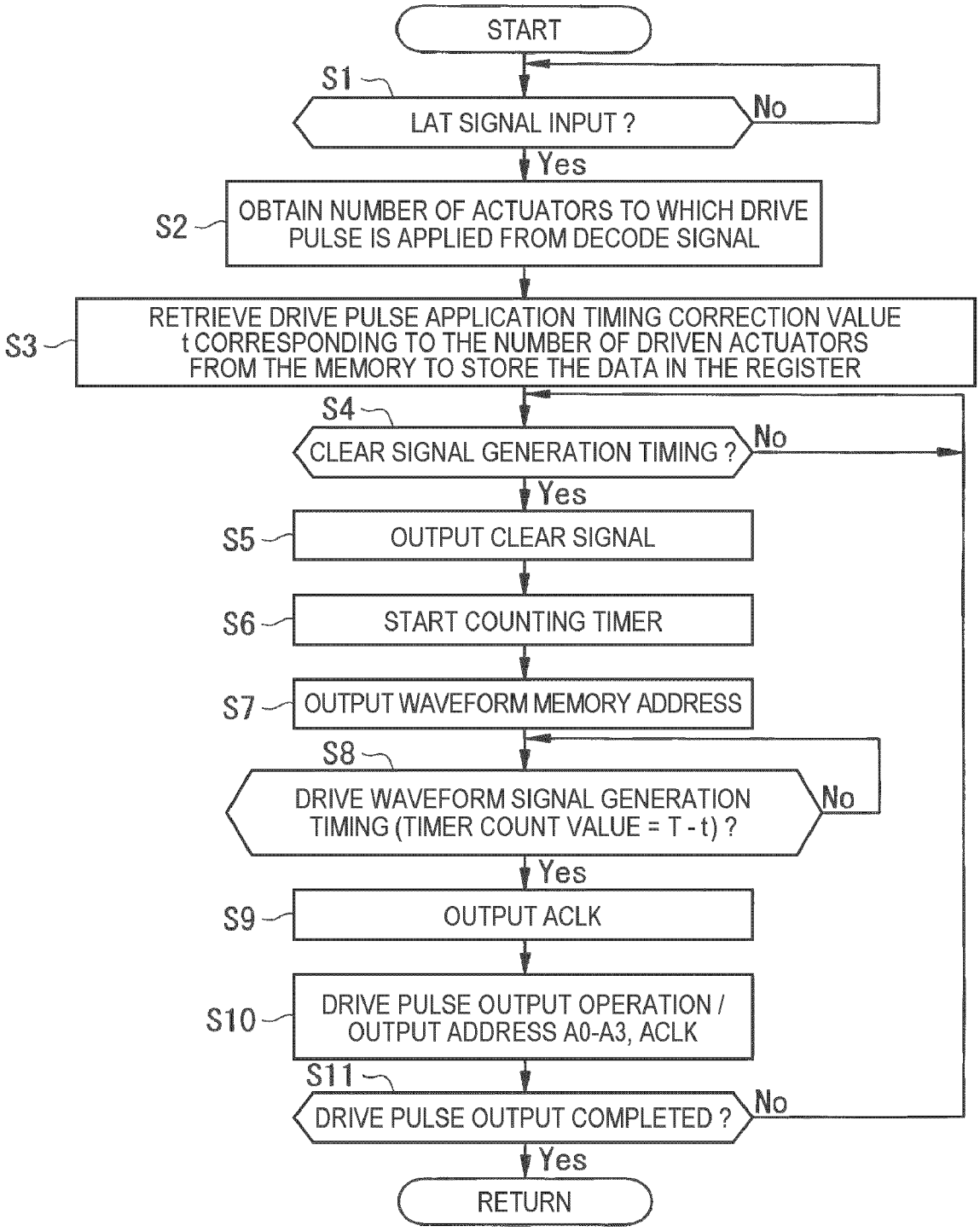
FIG. 15 is a flowchart showing an arithmetic processing for outputting address data and a first clock signal performed in a control circuit shown in FIG. 12.

Subsequently, FIG. 12 shows an output circuit for the waveform forming data DATA output to the drive waveform generator 70, the write enable signal DEN, the write clock signal WCLK, the write address data A0 through A3, the first clock signal ACLK, the second clock signal BCLK, and the clear signal CLER. The output circuit is actually configured in the control section 62 by software, and is shown in the form of a block diagram with blocks illustrating the respective functions of the circuit. The output circuit is provided with a shift register 111 for sequentially storing the drive pulse selection data SI&SP for designating which actuators should eject the liquid, a latch circuit 112 for temporarily storing the data of the shift register 111 in response to the latch signal LAT, a decoder 113 for decoding the data of the latch circuit 112 in response to the latch signal LAT, a control circuit 114 for outputting the waveform forming data DATA, the write enable signal DEN, the write clock signal WCLK, the write address data A0 through A3, the first clock signal ACLK, the second clock signal BCLK, and the clear signal CLER in accordance with the data decoded in the decoder 113 and the latch signal LAT obtained using the arithmetic processing described more fully below, and, as shown in FIG. 15, a delay time memory 115 for storing delay time periods corresponding to the number of actuators to be driven at the same time.

Next, the delay time periods corresponding to the number of actuators driven at the same time, which is stored in the delay time memory 115 will be explained. Since the actuator has a capacitance, when the number of nozzles for emitting the liquid jet, namely the number of actuators to be driven at the same time varies, the characteristics of the low-pass filter and the capacitances of the actuators varies. Each time the actuator connects to the low-pass filter, the capacitance is connected in parallel one after another, thus the characteristic of the low-pass filter by the low-pass filter and the capacitances of the actuators varies.

Figure 13:
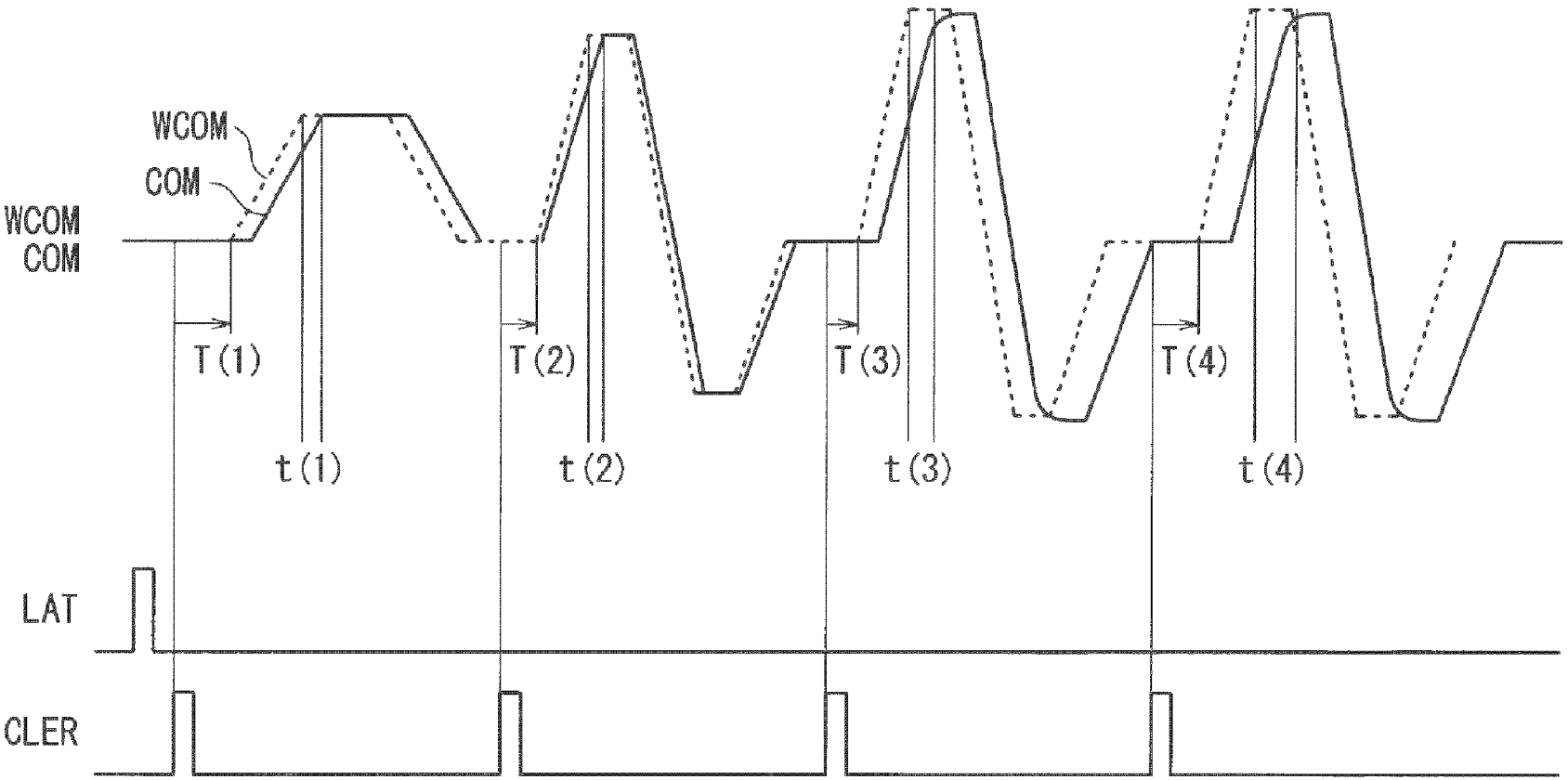
FIG. 13 is an explanatory diagram showing the delay in the drive pulse with respect to the drive waveform signal.

FIG. 13 shows the phase delay, shown as the solid line, which is caused in the drive signal COM by the low-pass filter of the drive circuit. More specifically, FIG. 13 illustrates the phase delay of the drive pulses with respect to the original drive waveform signal WCOM, shown as the dotted line. In the present embodiment, the latched data is cleared in response to the output of the clear signal CLER as described above, and then generation of the drive waveform signal WCOM is started when the first clock signal ACLK is output. As shown in FIG. 13, when the drive waveform signal WCOM has a shape comprising the joining of four drive pulses, the time period from the clear signal CLER to the first clock signal ACLK, comprising the drive pulse application timing initial values T(1) through T(4) are defined as described above. With respect to the liquid jet emission timing initial values T(1) through T(4), there is additional delay time periods t(1) through t(4) in accordance with the number of the actuators to be driven at the same time, in other words, the number of the actuators connected to the drive pulse.

The number of the actuators to be connected to the drive pulse is previously known from the drive pulse selection data SI&SP. Therefore, in the present embodiment, the delay time periods t(1) through t(4) are stored in the delay time memory 115 as drive pulse application timing correction values t, which correspond to the number of actuators connected to the drive pulse as shown in FIG. 14. Using this data, the drive pulses are applied to the actuators the drive pulse application timing correction values t earlier than the drive pulse application timing initial values T. Specifically, the generation timing of the drive waveform signal WCOM corresponding to the drive pulse is set earlier. It should be noted that the drive pulse application timing correction values t can be obtained by experimentation or obtained from the known capacitances of the actuators.

FIG. 15 shows the arithmetic process used for outputting the first clock signal ACLK and the address data A0 through A3, which is performed in the control circuit 114 shown in FIG. 12. In the present arithmetic process, a determination is first made at step S1 in order to determine whether or not the latch signal LAT is input. If the latch signal LAT has been input, the process proceeds to step S2, otherwise the process is placed in the standby condition.

At step S2, the number of the actuators provided with the drive pulses at the same time is obtained from the drive pulse selection data SI&SP decoded by the decoder 113.

Subsequently, the process proceeds to step S3, and the drive pulse application timing correction value t corresponding to the number of the actuators to be driven at the same time is retrieved from the delay time memory 115, and the data is stored in the register (not shown).

Subsequently, the process proceeds to step S4, and a determination is made as to whether or not the clear signal CLER generation timing has been reached. If the clear signal CLER has been reached, the process proceeds to step S5, otherwise the process is placed in the standby state.

At step S5, the clear signal CLER is output.

Then, the process proceeds to step S6 to start counting using a timer.

Subsequently, the process proceeds to step S7 to output the address data A1 of the waveform memory.

Then, the process proceeds to step S8, and a determination is made as to whether or not the generation timing of the drive waveform signal WCOM has been reached or not using the count value of the timer. More specifically, if the count value of the timer is equal to the drive pulse application timing initial value T subtracted by the drive pulse application timing correction value t, the generation timing of the drive waveform signal WCOM has been reached, and the process proceeds to the step S9, otherwise the process becomes the is placed in the standby state.

At step S9, the first clock signal ACLK is output.

Subsequently, the process proceeds to step S10, and drive pulse outputting operations for outputting the address data A0 through A3 or outputting the first clock signal ACLK are performed.

Subsequently, the process proceeds to step S11, and a determination is made as to whether or not the output of the drive pulse has been completed. If the output of the drive pulse has been completed, the process proceeds to the main program, otherwise the process proceeds to step S4.

Figure 16:
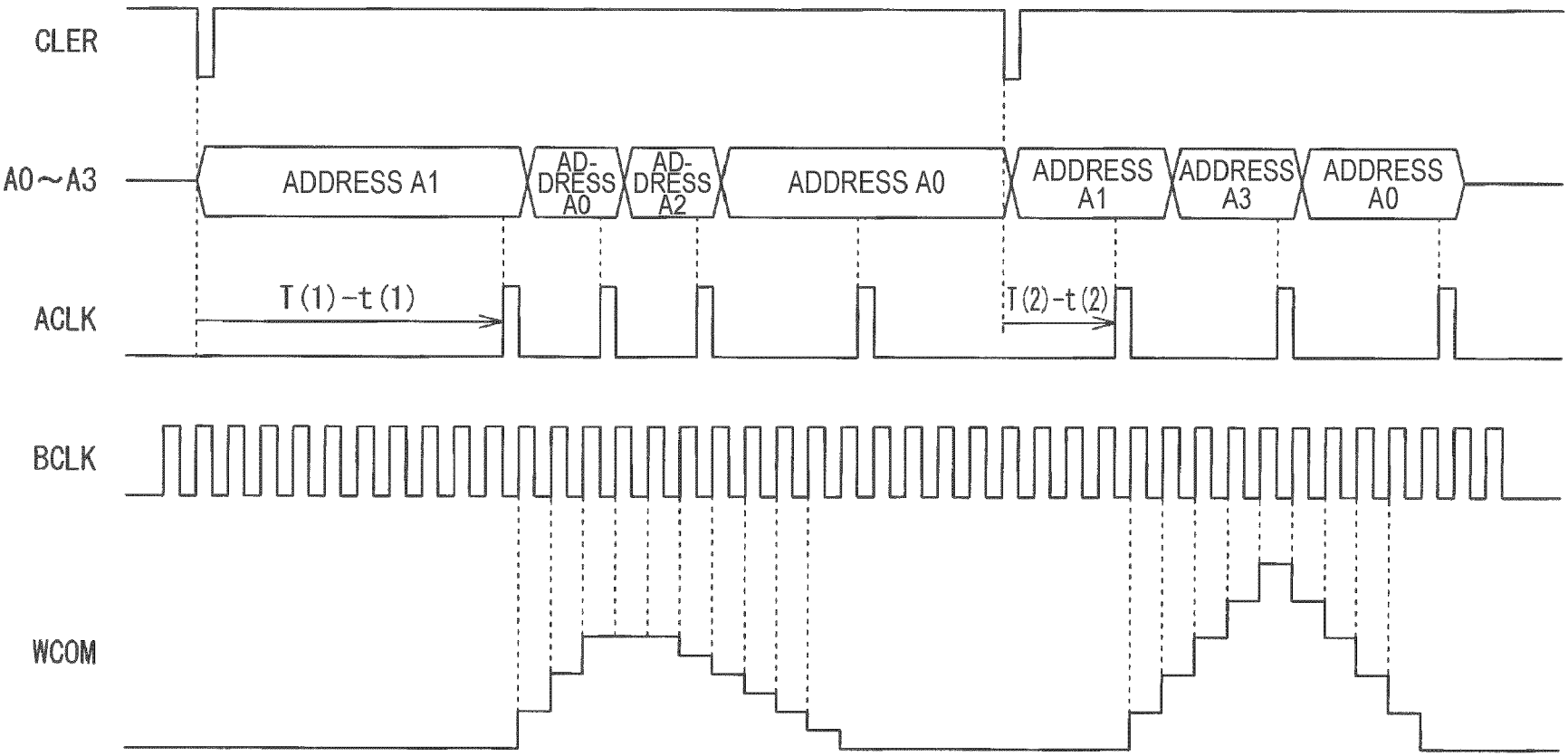
FIG. 16 is an explanatory diagram of a drive waveform signal by the arithmetic processing shown in FIG. 15.

According to the present arithmetic process, as shown in FIG. 16, after the clear signal CLER is output, the address data A1 of the waveform memory is output, then the first clock signal ACLK is output after the time period obtained by subtracting the drive pulse application timing correction value t from the drive pulse application timing initial value T has elapsed, and from that time, the drive waveform signal WCOM corresponding to the drive pulse is generated. Since the drive waveform signal WCOM corresponding to the drive pulse is corrected using the phase delay of the drive pulse generated according to the number of the actuators to be driven, the drive pulse is applied substantially in the set application timing, thus the liquid is emitted at the appropriate timing.

As described above, according to the present embodiment, since the drive pulse application timing correction values t, which correspond to the number of the actuators to be driven are stored, and the application timing (generation timing) of the drive pulse to the actuators is arranged to be corrected using the drive pulse application timing correction value t it is easier to configure the drive circuit, and it is possible to compensate for the phase delay in the drive pulse in order to correct the liquid emitting timing.

It should be noted that although a line head printing apparatus is described as an example of a apparatus capable of performing aspects of the present invention, the liquid jet apparatus and the method of adjusting the phase of the drive pulse according to the present invention can also be applied to a multi-pass printing apparatus or any other type of printing apparatus for printing letters or images on a print medium by emitting liquid. Further, the components of the liquid jet apparatus or the printing apparatus of the present invention can be replaced with an arbitrary configuration capable of exerting a similar function, or other components may be added without departing from the meaning and scope of the claims.

Further, various types of liquid may be emitted from the liquid jet apparatus of the present invention, without particular limitation, and liquids (including dispersion liquids such as suspensions or emulsions) containing various kinds of materials, such as the examples mentioned below, may be used. Specifically, ink containing a filter material of a color filter, a light emitting material for forming an EL light emitting layer in an organic electroluminescence (EL) device, a fluorescent material for forming a fluorescent substance on an electrode in a field emission device, a fluorescent material for forming a fluorescent substance in a plasma display panel (PDP) device, electrophoretic material for forming an electrophoretic substance in an electrophoretic display device, a bank material for forming a bank on a substrate W, various coating materials, a liquid electrode material for forming a electrode, a particle material for forming a spacer for forming a microscopic cell gap between two substrates, a liquid metal material for forming metal wiring, a lens material for forming a microlens, a resist material, a light diffusion material for forming a light diffusion material, and so on may be used.

Further, in the present invention, the print medium used as a target for the liquid jet emission is not limited to a piece of paper, but can also be a film, a cloth, a nonwoven cloth, or other medium, or works such as various substrates, such as a glass or a silicon substrate.

What is claimed is:

1. A liquid jet apparatus comprising:

a plurality of nozzles associated with a liquid jet head;

a plurality of actuators corresponding to the nozzles; and a drive unit configured to apply a drive pulse to each of the plurality of actuators, wherein, the drive unit compensates for electrical interference generated by more than one of the plurality of actuators being driven at the same time by modifying the timing that the drive pulse is sent to each of the plurality of actuators based on the number of the plurality of actuators being driven at the same time.

2. The liquid jet apparatus according to claim 1, wherein the drive unit compensates for electrical interference by adjusting the timing of the application of the drive pulse based on the number of the plurality of actuators to be driven at the same time.

3. The liquid jet apparatus according to claim 1, wherein the drive unit compensates for electrical interference by:

storing a correction value that corresponds to the number of the actuators to be driven at the same time;

based on the stored correction value, adjusting the timing of the application of the drive pulse to each of the actuators to be driven at the same time.

4. A method of driving a plurality of nozzles associated with a plurality of nozzles of a liquid jet head of a liquid jet apparatus, comprising:

determining a number of the plurality of actuators that are to be driven at the same time;

generating a drive pulse that is corrected to compensate for electrical interference generated by multiple actuators being driven at the same time by modifying the timing that the drive pulse is sent to each of the plurality of actuators based on the number of the plurality of actuators being driven at the same time; and applying the corrected drive pulse to the actuators that are to be driven at the same time, such that the actuators cause the nozzles to eject liquid.

5. The method according to claim 4, further comprising storing a correction value that corresponds to the number of the actuators to be driven at the same time.

6. The method according to claim 5, wherein generating the drive pulse that is corrected to compensate for electrical interference comprises, based on the stored correction value, adjusting the timing of the application of the drive pulse to each of the actuators to be driven at the same time.

7. The method according to claim 4, wherein the drive pulse is generated by a drive unit of the printing apparatus.

* * * * *